US010025242B2

(12) United States Patent
Koyama

(10) Patent No.: US 10,025,242 B2
(45) Date of Patent: Jul. 17, 2018

(54) FIXING DEVICE IN ELECTROPHOTOGRAPHY TECHNOLOGY

(71) Applicant: BROTHER KOGYO KABUSHIKI KAISHA, Nagoya-shi, Aichi-ken (JP)

(72) Inventor: Tatsuya Koyama, Toyoake (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/468,635

(22) Filed: Mar. 24, 2017

(65) Prior Publication Data

US 2017/0285540 A1 Oct. 5, 2017

(30) Foreign Application Priority Data

Mar. 31, 2016 (JP) ..... 2016-070765

(51) Int. Cl.
*G03G 15/20* (2006.01)

(52) U.S. Cl.
CPC ..... *G03G 15/2053* (2013.01)

(58) Field of Classification Search
CPC ..... G03G 15/2017; G03G 15/2028; G03G 15/2053; G03G 2215/2035
See application file for complete search history.

(56) References Cited

U.S. PATENT DOCUMENTS 6,266,510 B1 * 7/2001 Curry ..... G03G 15/2064 399/329
7,177,579 B2 * 2/2007 Uchida ..... G03G 15/2064 219/216
9,037,058 B2 * 5/2015 Iwata ..... G03G 15/2053 399/329
2010/0303526 A1 12/2010 Hayase
2012/0177423 A1 7/2012 Imada et al.
2014/0086649 A1 * 3/2014 Hazeyama ..... G03G 15/2053 399/329

FOREIGN PATENT DOCUMENTS

JP 2010-276814 A 12/2010
JP 2012-145709 A 8/2012

* cited by examiner

*Primary Examiner* — Gregory H Curran
(74) *Attorney, Agent, or Firm* — Merchant & Gould P.C.

(57) ABSTRACT

A fixing device includes an endless belt, a girder disposed inside of a loop of the endless belt and extending in the width direction, a plate disposed between the girder and the endless belt, a pressing member disposed outside of the loop of the endless belt, a heater disposed inside the loop pf the endless belt, a first support disposed between the plate and the girder, and a second support disposed between the plate and the girder while being away from the first support. The first height of the second support is greater than the second height of the second support. A first difference between the first height of the first support and the second height of the first support is less than a second difference between the first height of the second support and the second height of the second support.

10 Claims, 7 Drawing Sheets

FIXING DEVICE IN ELECTROPHOTOGRAPHY TECHNOLOGY

CROSS-REFERENCE TO RELATED APPLICATION

This application claims priority from Japanese Patent Application No. 2016-070765, filed on Mar. 31, 2016, which is incorporated herein by reference in its entirety.

TECHNICAL FIELD

The disclosure relates to a fixing device in electrophotography technology.

BACKGROUND

A fixing device included in a printer or a copier is known. Such fixing device may include an endless belt, a pressing member, a nip member, a stay, and a heater. The pressing member has a width extending in a widthwise direction of the endless belt and is located outside of a loop of the endless belt so as to contact a peripheral surface of the endless belt. The nip member extends in the widthwise direction of the endless belt and is located inside of the loop of the endless belt such that the endless belt is sandwiched between the nip member and the pressing member. The stay is disposed further inside of the loop of the endless belt than the nip member and is configured to restrict that the nip member moves away from the endless belt. These structures of the fixing device allow a sheet to be heated by the heater while conveyed between the endless belt and the pressing member.

While the stay supports both ends of the nip member in the widthwise direction, a pressure by the pressing member may cause a middle portion of the nip member in the widthwise direction to bend so as to be away from the pressing member. A certain fixing device includes a configuration to offset the middle portion of the nip member toward the pressing member.

SUMMARY

Such configuration of the certain fixing device may cause some wrinkle on the conveyed sheet because of speed difference between the widthwise end of the sheet and a middle portion of the sheet. Such speed difference may occur because the middle portion of the sheet would receive more pressure from the nip member than the widthwise end of the sheet. The present disclosure illustrates a configuration to eliminate or reduce the wrinkle on the conveyed sheet.

DETAILED DESCRIPTION OF EMBODIMENTS

Figure 1:
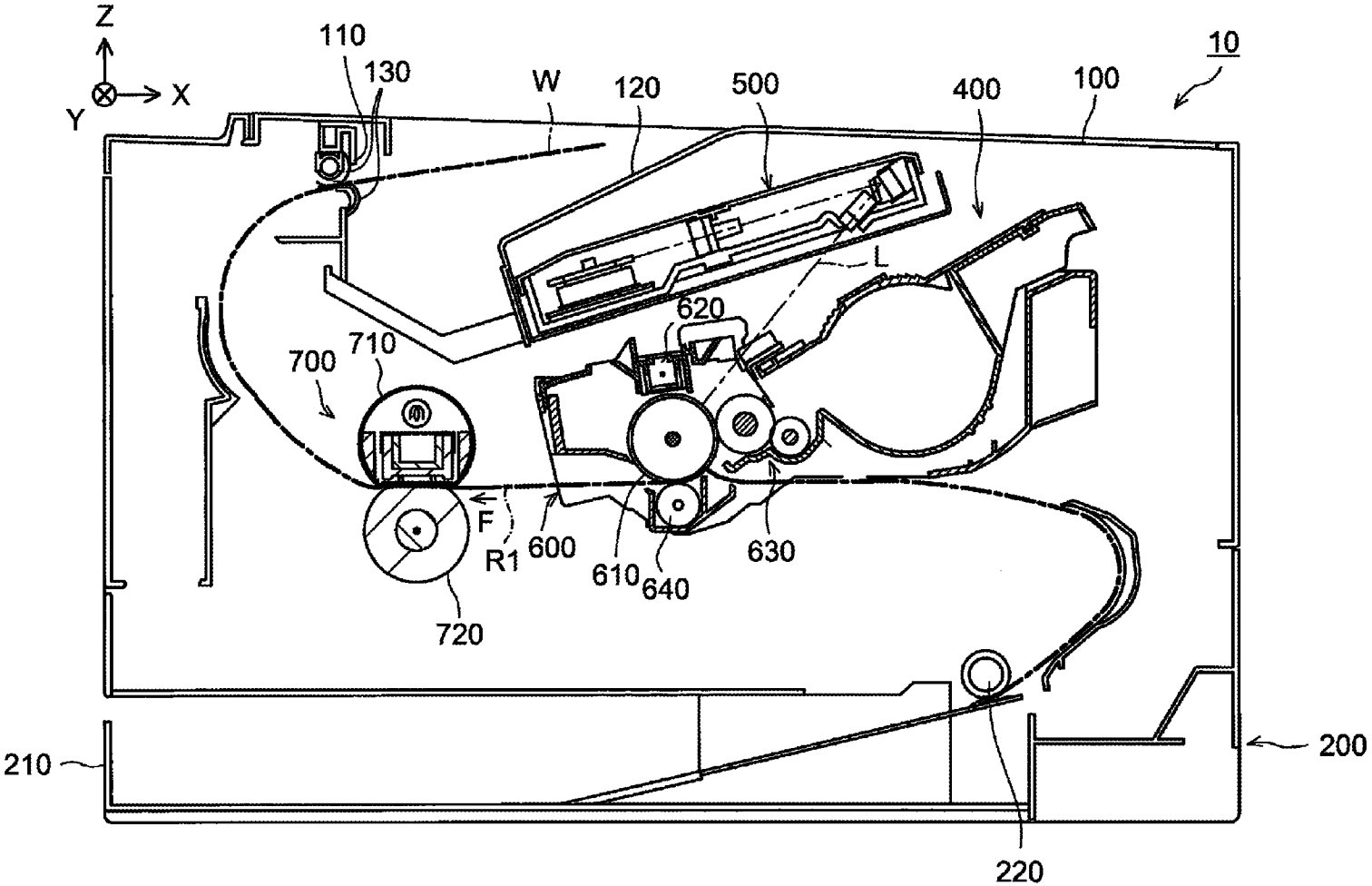
FIG. 1 illustrates a perspective view of a printer of one aspect of the present disclosure.

A configuration of a printer 10, which is one embodiment of the present disclosure, will be described. FIG. 1 illustrates a perspective view of the printer 10. X axis, Y axis, and Z axis are shown in the FIGS. 1 and 2 for indicating each direction. In the present disclosure, Z-positive direction refers to a upward direction. Z-negative direction refers to a downward direction. X-positive direction refers to a frontward direction. X-negative direction refers to a backward direction. Y-positive direction refers to a rightward direction. Y-negative direction refers to a leftward direction.

The printer 10 is configured to form an image on a sheet W, for example, a paper sheet, or a plastic film, with black toner in an electrophotography technology. The printer 10 may be an example of an image forming apparatus.

As shown in FIG. 1, the printer 10 includes a housing 100, a sheet feeder 200, and an image forming device 400. The housing 100 accommodates the sheet feeder 200 and the image forming device 400. At a top portion of the housing 100, the housing 100 further includes a discharge port 110 and a discharge tray 120. The housing 100 further accommodates a discharge roller 130 adjacent to the discharge port 110.

The sheet feeder 200 includes a tray 210 and a pick-up roller 220. The tray 210 accommodates a stack of sheet W. The pick-up roller 220 picks up a sheet W in the tray 210 and transfers the picked sheet W to the image forming device 400.

The image forming device 400 includes a exposure device 500, a process unit 600, and a fixing device 700. The exposure device 500 emits laser beam L such that the laser beam L is irradiated to a photosensitive drum 610 of the process unit 600.

The process unit 600 includes the photosensitive drum 610, a charger 620, a developing roller 630, and a transfer roller 640. The charger 620 uniformly charges the surface of the photosensitive drum 610. The laser beam L emitted from the exposure device 500 causes the surface of the photosensitive drum 610, which is charged by the charger 620, to form an electrostatic latent image Toner supplied from the developing roller 630 to the surface of the photosensitive drum 610 develops the electrostatic latent image into toner image. The toner image on the surface of the photosensitive drum 610 is transferred to the sheet W while the sheet W passes between the photosensitive drum 610 and the transfer roller 640.

The fixing device 700 heats the sheet W transferred from the process unit 600 such that the toner image is fixed onto the sheet W and the image is formed on the sheet W. Detail structure of the fixing device 700 is described later. The discharge roller 130 transfers the sheet W having the toner image fixed thereon to the discharge tray 120 via the discharge port 110. Hereinafter, a sheet passage from the sheet feeder 200 to the discharge roller 130 may be referred to a sheet passage R1. It may be explained that the sheet W is transferred, in the fixing device 700, in a "forward direction F" along the sheet passage R1.

Figure 2:
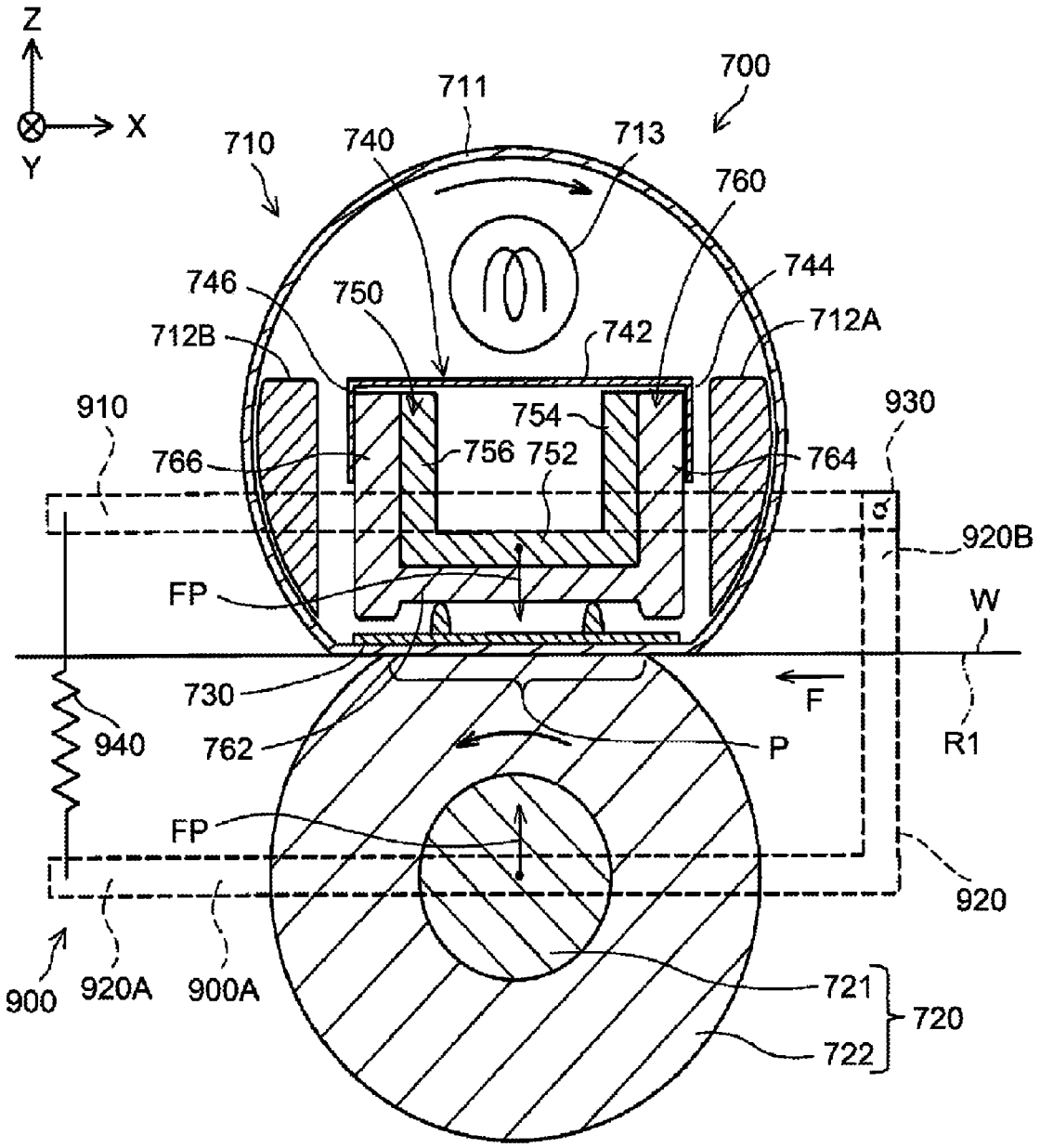
FIG. 2 illustrates a left-side view of a fixing device of one aspect of the present disclosure.
Figure 3:
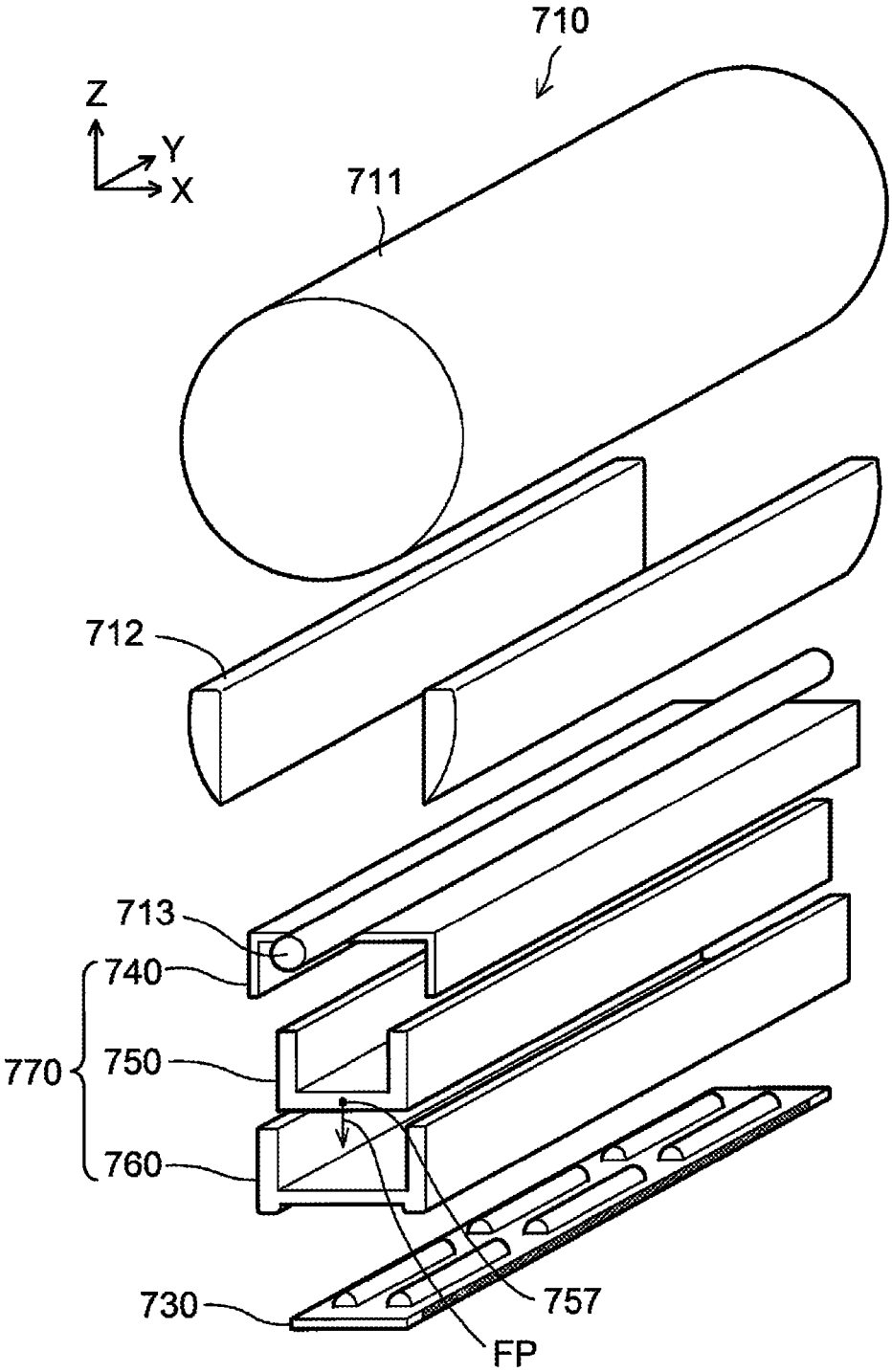
FIG. 3 illustrates a perspective view of a heating portion of the fixing device of one aspect of the present disclosure.

As shown in FIGS. 1-3, the fixing device 700 includes a heating portion 710 and a pressed portion 720 and a pressing portion 900. The pressed portion 720 is disposed below the heating portion 710. The pressing portion 900 presses the pressed portion 720 toward the heating portion 710.

The heating portion 710 includes an endless belt 711, a halogen lamp 713, a reflector 740, a stay 750, a thermal insulator 760, a nip plate 730 and a guide 712.

The endless belt 711 includes a base layer made of polyimide resin with a coating layer, which is made of fluorine resin, on an outer surface of the base layer. The endless belt 711 is rotatable in a particular direction such that the sheet W is transferred in the forward direction F.

The halogen lamp 713 has a longitudinal shape extending in a direction parallel to a rotational axis of the photosensitive drum 610. The halogen lamp 713 is disposed inside a loop of the endless belt 711 and is spaced apart from an inner surface of the endless belt 711. The halogen lamp 713 is an example of the heater.

The nip plate 730 is disposed inside the loop of the endless belt 711 and contacts the inner surface of the endless belt 711.

The reflector 740 is a longitudinal metal plate extending substantially parallel to the halogen lamp 713. The reflector 740 is disposed inside the loop of the endless belt 711 and is disposed below the halogen lamp 713. The reflector 740 includes a first bent portion 744, a second bent portion 746, and a top portion 742. The first bent portion 744, the second bent portion 746, and the top portion 742 are integrally made of metal, for example, stainless steel, or aluminum. The first bent portion 744 extends downwardly from one end of the top portion 742. The second bent portion 746 extends downwardly from the other end of the top portion 742 and faces the first bent portion 744 spaced apart from the second bent portion 746. The top portion 742 includes a mirror surface facing upwardly toward the halogen lamp 713. The mirror surface of the top portion 742 may reflect heat from the halogen lamp 713 upwardly toward the inner surface of the endless belt 711.

The stay 750 is a longitudinal metal plate extending substantially parallel to the halogen lamp 713. The stay 750 is disposed inside the loop of the endless belt 711 and is disposed below the reflector 740. The stay 750 includes a first wall 754, a second wall 756, and a bottom plate 752. The first wall 754, the second wall 756, and the bottom plate 752 are integrally made of metal, for example, stainless steel, or aluminum. The first wall 754 extends upwardly from one end of the bottom plate 752. The second wall 756 extends upwardly from the other end of the bottom plate 752 and faces the first wall 754 such that the second wall 756 is spaced apart from the first wall 754. The first wall 754 and the second wall 756 are disposed in the space between the first bent portion 744 and the second bent portion 746. The first wall 754 is closer to the first bent portion 744 than the second wall 756 is. The second wall 756 is closer to the second bent portion 756 than the first wall 754 is.

The thermal insulator 760 is made of resin and extends substantially parallel to the halogen lamp 713. The thermal insulator 760 includes a first insulating wall 764, a second insulating wall 766, and a bottom insulating plate 762. The first insulating wall 764, the second insulating wall 766, and the bottom insulating plate 762 are integrally made of resin. The first insulating wall 764 extends upwardly from one end of the bottom insulating plate 762. The second insulating wall 766 extends upwardly from the other end of the bottom insulating plate 762 and faces the first insulating wall 764 such that the second insulating wall 766 is spaced apart from the first insulating wall 764. The thermal insulator 760 is disposed inside the loop of the endless belt 711 such that the bottom insulating plate 762 is disposed below and contacts the bottom plate 752 of the stay 750, the first insulating wall 764 is between the first wall 754 and the first bent portion 744, and the second insulating wall 766 is between the second wall 756 and the second bent portion 746. The thermal insulator 760 may reduce heat conduction between the nip plate 730 and the stay 750. The thermal insulator 760 may also reduce heat conduction between the reflector 740 and the stay 750. A combination of the stay 750 and the thermal insulator 760 may be an example of the girder.

The nip plate 730 is disposed below and contacts the bottom insulating plate 762. The nip plate 730 also contacts the inner surface of the endless belt 711.

The guide 712 includes a first guide 712A and a second guide 712B. Each of the first guide 712A and the second guide 712B is made of resin and includes an arc portion. The first guide 712A is disposed between the first bent portion 744 and the inner surface of the endless belt 711 such that the arc portion of the first guide 712A contacts the inner surface of the endless belt 711. The second guide 712B is disposed between the second bent portion 746 and the inner surface of the endless belt 711 such that the arc portion of the second guide 712B contacts the inner surface of the endless belt 711.

The pressed portion 720 includes a metal shaft 721 and a cylindrical elastic body 722 that is formed around the metal shaft 721. It would be said that the pressed portion 720 is a roller rotatable about the metal shaft 721. The metal shaft 721 extends substantially parallel to the halogen lamp 713. The metal shaft 721 holds a gear for receiving a driving force from a motor. As shown in FIG. 1, the pressed portion 720 is disposed outside the loop of the endless belt 711 and is disposed below the heating portion 710 such that the sheet passage R1 is between the pressed portion 720 and the heating portion 710. The pressed portion 720 contacts an outer surface of the endless belt 711. The pressed portion 720 is rotatable about the metal shaft 721. The pressed portion 720 may be an example of pressing member.

The pressing portion 900 includes a first pressing portion 900A and a second pressing portion (not shown). The first pressing portion 900A is disposed at one end of the metal shaft 721. The second pressing portion is disposed at the other end of the metal shaft 721. The first pressing portion 900A is shown in FIG. 2. The following is an explanation of the first pressing portion 900A, however, the second pressing portion has the same configuration as the first pressing portion 900A. The first pressing portion 900A includes an upper arm 910, a lower arm 920, and a coil spring 940.

The lower arm 920 includes a first lower arm 920A and a second lower arm 920B. The first lower arm 920A extends horizontally and is disposed on the one end of the metal shaft 721. The second lower arm 920B extends upwardly from the first lower arm 920A. The first lower arm 920A and the second lower arm 920B are formed integrally. The upper arm 910 extends substantially parallel to the first lower arm 920A. The upper arm 910 includes a shaft 930 that is inserted into a hole of the second lower arm 920B such that the upper arm 910 and the lower arm 920 are pivotable relative to each other.

One end of the coil spring 940 is connected to the upper arm 910. The other end of the coil spring 940 is connected to the first lower arm 920A. While the coil spring 940 is connected to the upper arm 910 and the first lower arm 920A, the coil spring 940 is being pulled. The coil spring 940 may give upward force FP, toward the stay 750, to the one end of the metal shaft 721 via the first lower arm 920A.

The stay 750 includes a receiving part 757 at each end. The upper arm 910 is disposed on the receiving 757 while connected to the coil spring 940. The coil spring 940 may also give downward force FP, toward the pressed portion 720, to the receiving part 757 via the upper arm 910. The nip plate 730 receives the downward force FP via the stay 750 and the thermal insulator 760. The configuration of the pressing portion 900 may cause the pressed portion 720 to be pressed against the endless belt 711 upwardly toward the nip plate 730. Thus, a nip portion P is defined between the endless belt 711 and the pressed portion 720.

Turning on the halogen lamp 713 would cause the halogen lamp 713 to generate heat. The heat causes the endless belt 711 to be heated and the temperature of the endless belt 711 to increase. The motor may be activated to rotate the metal shaft 721. As the metal shaft 721 rotates, the cylindrical elastic body 722 also rotates. The endless belt 711 follows the rotation of the cylindrical elastic body 722 and rotates. The rotation of the cylindrical elastic body 722 and the rotation of the endless belt 711 transport the sheet W, which is transferred from the process unit 600, into the nip portion P in the forward direction F. At the nip portion P, the sheet W receives the heat from the endless belt 711 while sandwiched and pressed between the endless belt 711 and the the cylindrical elastic body 722.

Figure 4:
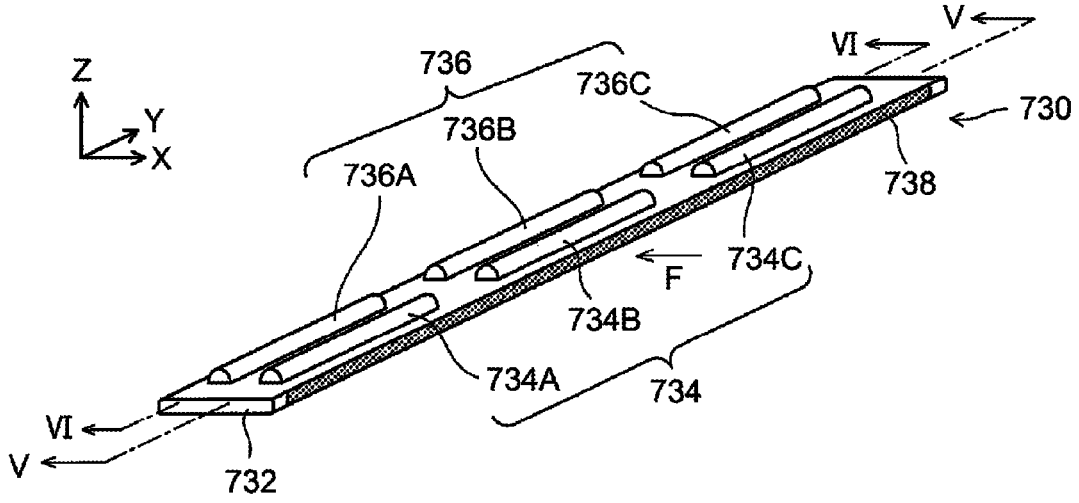
FIG. 4 illustrates a perspective view of a nip plate of one aspect of the present disclosure.

As shown in FIG. 4, the nip plate 730 is a plate-like member made of resin. The nip plate 730 includes a based plate 732, a first support 734 and a second support 736. Each of the first support 734 and the second support 736 may be formed integrally with an upper surface of the base plate 732 and extends upwardly from the upper surface of the base plate 732. The first support 734 and the second support 736 are disposed below the bottom insulating plate 762 of the thermal insulator 760. The base plate 732 has a rectangular shape with a uniform thickness. A pair of longitudinal end surface of the base plate 732 extends substantially parallel to the halogen lamp 713. The transverse end of the base plate 732 is substantially parallel to the forward direction F. As shown in FIG. 2, the lower surface of the base plate 732 contacts the inner surface of the endless belt 711. A low friction material 738 is attached to the lower surface of the base plate 732 and is also attached to both longitudinal end surfaces of the base plate 732. The low friction material 738 may be a cloth having lubricant-applied fibers. The frictional force generated between the low friction material 738 and the inner surface of the endless belt 711 may be less than the frictional force generated by a surface of the base plate 732 and the inner surface of the endless belt 711. The base plate 732 may be an example of the plate.

The first support 734 further extends substantially parallel to the longitudinal end surface of the base plate 732. The first support 734 includes three individual ribs 734A, 734B, and 734C. The rib 734B is disposed at a center region of the base plate 732 along the longitudinal end surface of the base plate 732. The rib 734A is disposed on one end portion of the first support 734 by a particular distance from the rib 734B. The rib 734C is disposed on the other end portion of the first support 734 by the particular distance from the rib 734B.

One or more of the ribs 734A, 734B, and 734C contacts the bottom insulating plate 762 of the thermal insulator 760. Each of the ribs 734A, 734B, and 734C has an elongated shape extending substantially parallel to the longitudinal end surface of the base plate 732. A top portion of each of the ribs 734A, 734B, and 734C has an arc shape.

The second support 736 further extends substantially parallel to the first support 734 and is disposed downstream of the first support 734 in the forward direction F. The second support 736 includes three individual ribs 736A, 736B, and 736C. Each of the ribs 736A, 736B, and 736C has an elongated shape extending substantially parallel to each of the ribs 734A, 734B, and 734C respectively. The rib 736B is disposed at a center region of the base plate 732 along the longitudinal end surface of the base plate 732. The rib 736A is disposed on one end portion of the second support 736 by a particular distance from the rib 736B. The rib 736C is disposed on the other end portion of the second support 736 by the particular distance from the rib 736B.

One or more of the ribs 736A, 736B, and 736C contacts the bottom insulating plate 762 of the thermal insulator 760. A top portion of each of the ribs 736A, 736B, and 736C has an arc shape.

Figure 5:
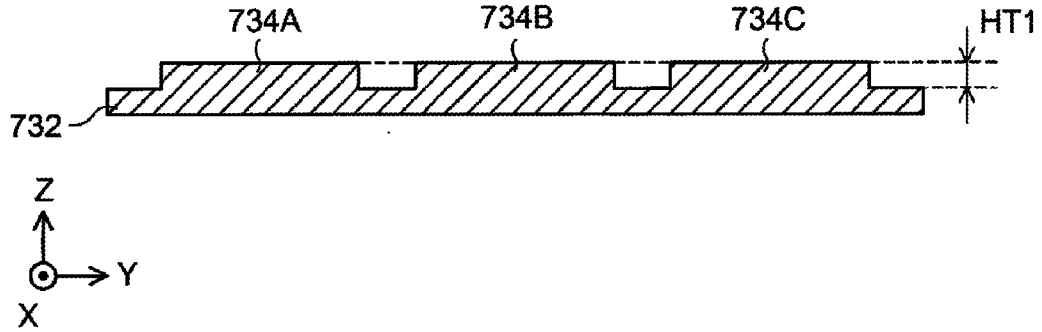
FIG. 5 illustrates a sectional view of the nip plate at V-V line shown in the FIG. 4.

As shown in FIG. 5, which illustrates a cross-sectional view of the ribs 734A, 734B, and 734C and the base plate 732, each of the ribs 734A, 734B, and 734C has the same height HT1. There is no height difference between the ribs 734A, 734B, and 734C.

Figure 6:
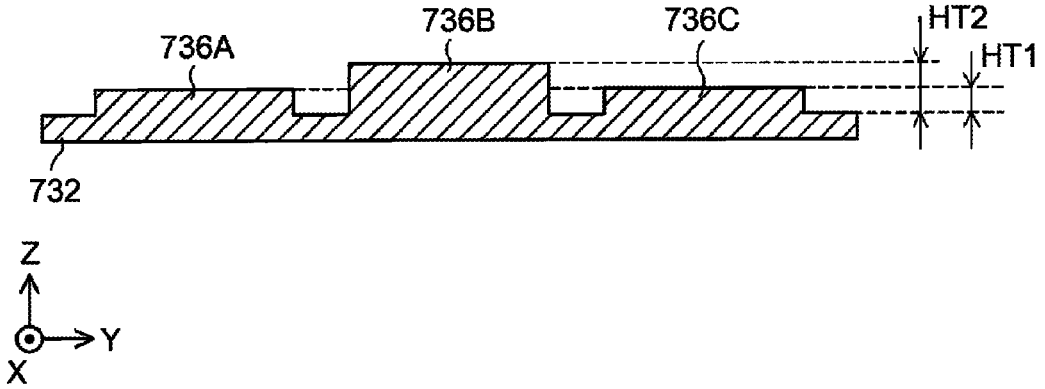
FIG. 6 illustrates a sectional view of the nip plate at VI-VI line shown in the FIG. 4.

As shown in FIG. 6, which illustrates a cross-sectional view of the ribs 736A, 736B, and 736C and the base plate 732, each of the rib 736A and the rib 736C has the same height HT1 as each of the ribs 734A, 734B, and 734C. The rib 736B has a height HT2 greater than the height HT1.

According to the above described configuration, the first support 734 and the second support 736 are disposed between the nip plate 730 and the thermal insulator 760. The middle part of the second support 736, which is the rib 736B, has the height HT2 greater than the height HT1 of the remaining part of the second support 736. The height difference between the middle part of the second support 736 and the remaining part of the second support 736 may be greater than the height difference between the middle part of the first support 734, which is the rib 734B, and the remaining part of the first support 734. These configurations may cause that the sheet W at the nip portion P may receive load that depends on the height of the first support 734 and the height of the second support 736.

Figure 7:
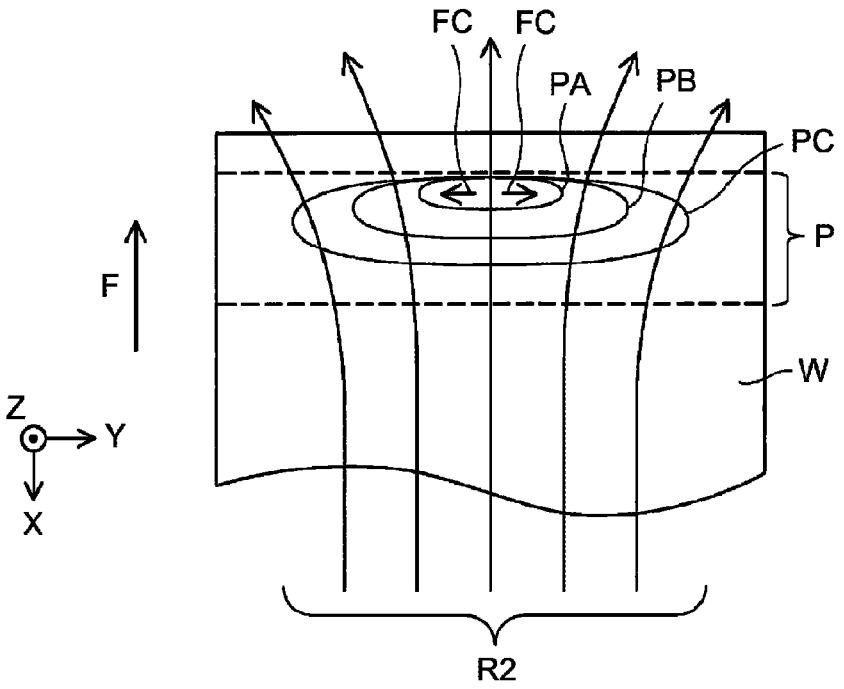
FIG. 7 illustrates distribution of loads PA, PB, and PC while the sheet passes the nip portion and further illustrates direction R2 of force for feeding the sheet.

FIG. 7 illustrates distribution of loads PA, PB, and PC while the sheet W passes the nip portion P and further illustrates direction R2 of force for feeding the sheet W. As shown in FIG. 7, because of the configuration of the ribs 734A, 734B, and 734C and the ribs 736A, 736B, and 736C, the sheet W, while passing the nip portion P, receives the load PA at the middle portion of the downstream end of the nip portion P in the forward direction. The sheet W also receives the load PB, which is less than the load PA, at a portion slightly away from the middle portion in the Y-positive and the Y-negative directions. The sheet W also receives the load PC, which is less than the load PB, at a portion further away from the middle portion in the Y-positive and the Y-negative directions. The sheet W is transferred faster at where the sheet W receives the load PA than where the sheet W receives the load PC. Thus, the sheet W received force FC that causes the sheet W to move from the middle portion in both the Y-positive and the Y-negative directions. The force FC at the downstream end of the nip portion P is greater than the force FC at the upstream end of the nip portion P.

According to the configuration of the present embodiment, the difference between the force FC at the downstream end of the nip portion P and the force FC at the upstream end of the nip portion P would cause fewer wrinkles on the sheet W. Because the force FC at the downstream end of the nip portion P is less than the force FC at the upstream end of the nip portion P, the sheet W that just reached the upstream end of the nip portion P would be hold at the nip portion P while receiving less force FC. Then, as the sheet W is transferred to the downstream end of the nip portion P, the greater force FC at the downstream end of the nip portion P pulls the sheet W in the Y-positive and the Y-negative directions, thereby causing fewer wrinkles on the sheet W.

Because each of the ribs 734A, 734B, and 734C has the same height HT1, the sheet W receives less force FC at the upstream end of the nip portion P such that the sheet W is properly hold at the upstream end of the nip portion P.

Because the first support 734 and the second support 736 are integrally formed with the base plate 732 instead of that the first support 734 and the second support 736 are attached to the base plate 732, the height HT1 and the height HT2 would be accurate.

The top portion of each of the ribs 734A, 734B, 734C, 736A, 736B, and 736C has an arc shape. The arc-shaped top portion would provide stable contact between at least one of the ribs 734A, 734B, 734C, 736A, 736B, and 736C and the bottom insulating plate 762 of the thermal insulator 760 even if the base plate 732 is not parallel to the bottom plate 752 of the stay 750 or the bottom insulating plate 762 of the thermal insulator 760.

Each of the ribs 734A, 734B, and 734C has an elongated shape extending substantially parallel to the longitudinal end surface of the base plate 732. The elongated shape provides large contact area between the ribs 734A, 734B, and 734C and the bottom insulating plate 762 of the thermal insulator 760, so that each of the ribs 734A, 734B, and 734C would receive fewer loads.

Similarly, each of the ribs 736A, 736B, and 736C has an elongated shape extending substantially parallel to the longitudinal end surface of the base plate 732. The elongated shape provides large contact area between the ribs 736A, 736B, and 736C and the bottom insulating plate 762 of the thermal insulator 760, so that each of the ribs 736A, 736B, and 736C would receive fewer loads.

Three individual ribs 734A, 734B, and 734C would conduct less heat to the bottom insulating plate of the thermal insulator 760 rather than a single elongated rib of the first support 734.

Similarly, three individual ribs 736A, 736B, and 736C would conduct less heat to the bottom insulating plate 762 of the thermal insulator 760 rather than a single elongated rib of the second support 736. The rib 736B may be easily formed on the base plate 732 with the height HT2, which is greater than the height HT1 of the ribs 736A and 736C.

Figure 8:
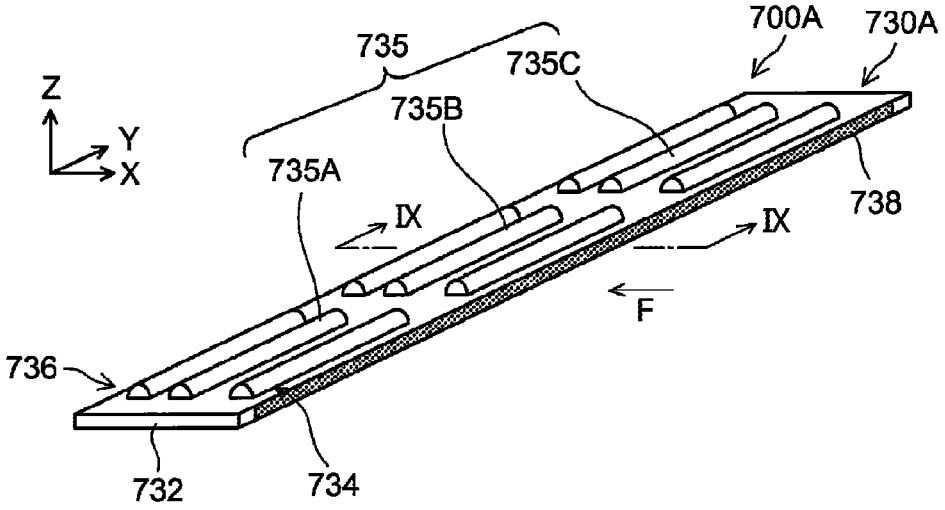
FIG. 8 illustrates a perspective view of the nip plate of another aspect of the present disclosure.

A configuration of a fixing device 700A, which is a first another embodiment of the present disclosure, having a nip plate 730A will be described below, with FIGS. 8 and 9.

The fixing device 700A of the first another embodiment includes a third support 735 on the base plate 732 as well as the first support 734 and the second support 736. The third support 735 is formed on the base plate 732 and is disposed between the base plate 732 and the bottom insulating plate 762 of the thermal insulator 760. The third support 735 may be integrally formed with the base plate 732.

The third support 735 is disposed between the first support 734 and the second support 736 in the forward direction F. That means, the third support 735 is disposed downstream of the first support 734 and upstream of the second support 736 in the forward direction F. The third support 735 includes three individual ribs 735A, 735B, and 735C. The rib 735B is disposed at a center region of the base plate 732 along the longitudinal end surface of the base plate 732. The rib 735A is disposed on one end portion of the third support 735 by a particular distance from the rib 735B. The rib 735C is disposed on the other end portion of the third support 735 by the particular distance from the rib 735B.

One or more of the ribs 735A, 735B, and 735C contacts the bottom insulating plate 762 of the thermal insulator 760. Each of the ribs 735A, 735B, and 735C has an elongated shape extending substantially parallel to the longitudinal end surface of the base plate 732. A top portion of each of the ribs 735A, 735B, and 735C has an arc shape.

Figure 9:
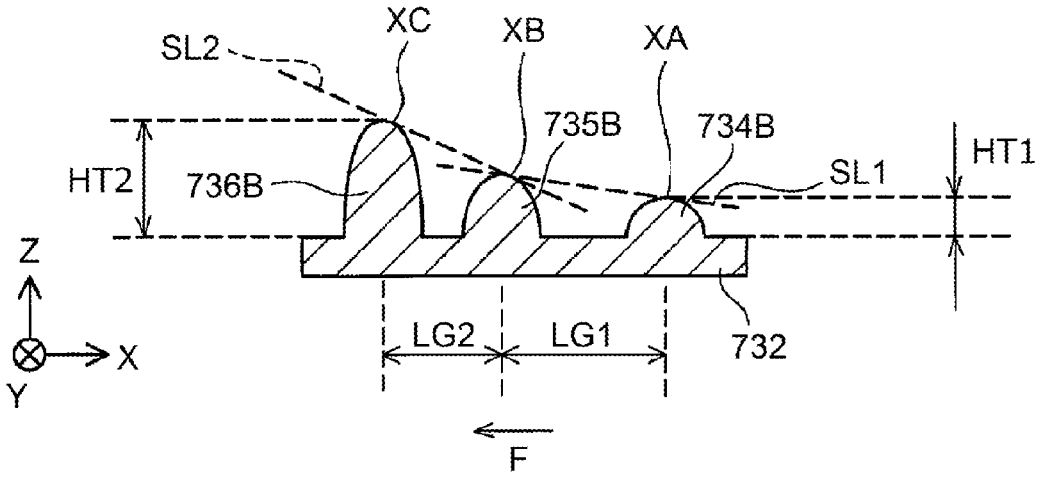
FIG. 9 illustrates a sectional view of the nip plate at IX-IX line shown in the FIG. 8.

As shown in FIG. 9, the rib 735B has a height greater than the height HT1 of the rib 734A and less than the height HT2 of the rib 736B. That means, the middle part of the third support 735 has a height greater than the middle part of the first support 734 and less than the middle part of the second support 736.

A distance LG2 between a top portion XB of the rib 735B and a top portion XC of the rib 736B in the forward direction F is less than a distance LG1 between the top portion XB of the rib 735B and a top portion XA of the rib 734B in the forward direction F. The top portion is the highest portion of the rib and may contact the bottom insulating plate 762 of the thermal insulator 760. The distance LG1 is an example of the first distance. The distance LG2 is an example of the second distance.

A slope SL2 of a line connecting the top portion XB of the rib 735B and the top portion XC of the rib 736B is greater than a slope SL1 of a line connecting the top portion XA of the rib 734A and the top portion XB of the rib 735B. The slope SL2 is calculated by dividing the height difference of the top portion XB and the top portion XC by the distance LG2. The slope SL1 is calculated by dividing the height difference of the top portion XA and the top portion XB by the distance LG1.

Therefore, according to the ribs 734B, 735B, and 736B, the height of the nip plate 730 gradually increases in the forward direction F and the sheet W at the nip portion P receives the load gradually increasing in the forward direction, otherwise the sheet W could have undesired wrinkles because of sharp increase of load.

A configuration of a fixing device 700B, which is a second another embodiment of the present disclosure, having a heater 710B, instead of the heater 710, will be described below, with FIG. 10. The heater 710B includes the endless belt 711, the halogen lamp 713, a nip plate 730B, a stay 750B, a reflector 740B and the guide 712.

The nip plate 730B is a flat metal plate without any support such as the first support 734 and the second support 736 in the embodiments described above. The nip plate 730B may be made of aluminum. The nip plate 730B is disposed inside the loop of the endless belt 711 and is disposed below the halogen lamp 713. A bottom outer surface of the nip plate 730B contacts the inner surface of the endless belt 711. The nip plate 730B has a rectangular shape. The longitudinal end of the nip plate 730B is substantially parallel to the halogen lamp 713. The transverse end of the nip plate 730B is along the forward direction F.

The stay 750B is a longitudinal metal plate extending substantially parallel to the halogen lamp 713. The stay 750B is disposed inside the loop of the endless belt 711 and is disposed above the nip plate 730B. The stay 750B includes a first wall 754B, a second wall 756B, and an upper plate 752B. The first wall 754B, the second wall 756B, and the upper plate 752B are integrally made of metal, for example, stainless steel, or aluminum. The first wall 754B extends downwardly from one end of the upper plate 752B. The second wall 756B extends downwardly from the other end of the upper plate 752B and faces the first wall 754B such that the second wall 756B is spaced apart from the first wall 754B. The halogen lamp 713 is disposed below the upper plate 752B and between the first wall 754B and the second wall 756B such that the first wall 754B is disposed upstream of the halogen lamp 713 in the forward direction F and the second wall 756B is disposed downstream of the halogen lamp 713 in the forward direction F.

The reflector 740B is a longitudinal metal plate extending substantially parallel to the halogen lamp 713. The reflector 740 is disposed inside the loop of the endless belt 711 and is disposed between the nip plate 730B and the stay 750B. The reflector 740B includes a first reflecting wall 744B, a second wall 746B, and a top portion 742B. The first reflecting wall 744B, the second reflecting wall 746B, and the top portion 742B are integrally made of metal, for example, stainless steel, or aluminum. The first reflecting wall 744B extends downwardly from one end of the top portion 742B. The second reflecting wall 746B extends downwardly from the other end of the top portion 742B and faces the first reflecting wall 744B spaced apart from the second reflecting wall 746B such that the halogen lamp 713 is disposed between the first reflecting wall 744B and the second reflecting wall 746B and is disposed below the top portion 742B. Each of the first reflecting wall 744B, the second reflecting wall 746B, and the top portion 742B includes an inner mirror surface such that the inner mirror surface of each of the first reflecting wall 744B, the second reflecting wall 746B, and the top portion 742B may reflect heat from the halogen lamp 713 toward the nip plate 730B. The heat would be then conducted to the inner surface of the endless belt 711.

Figure 10:
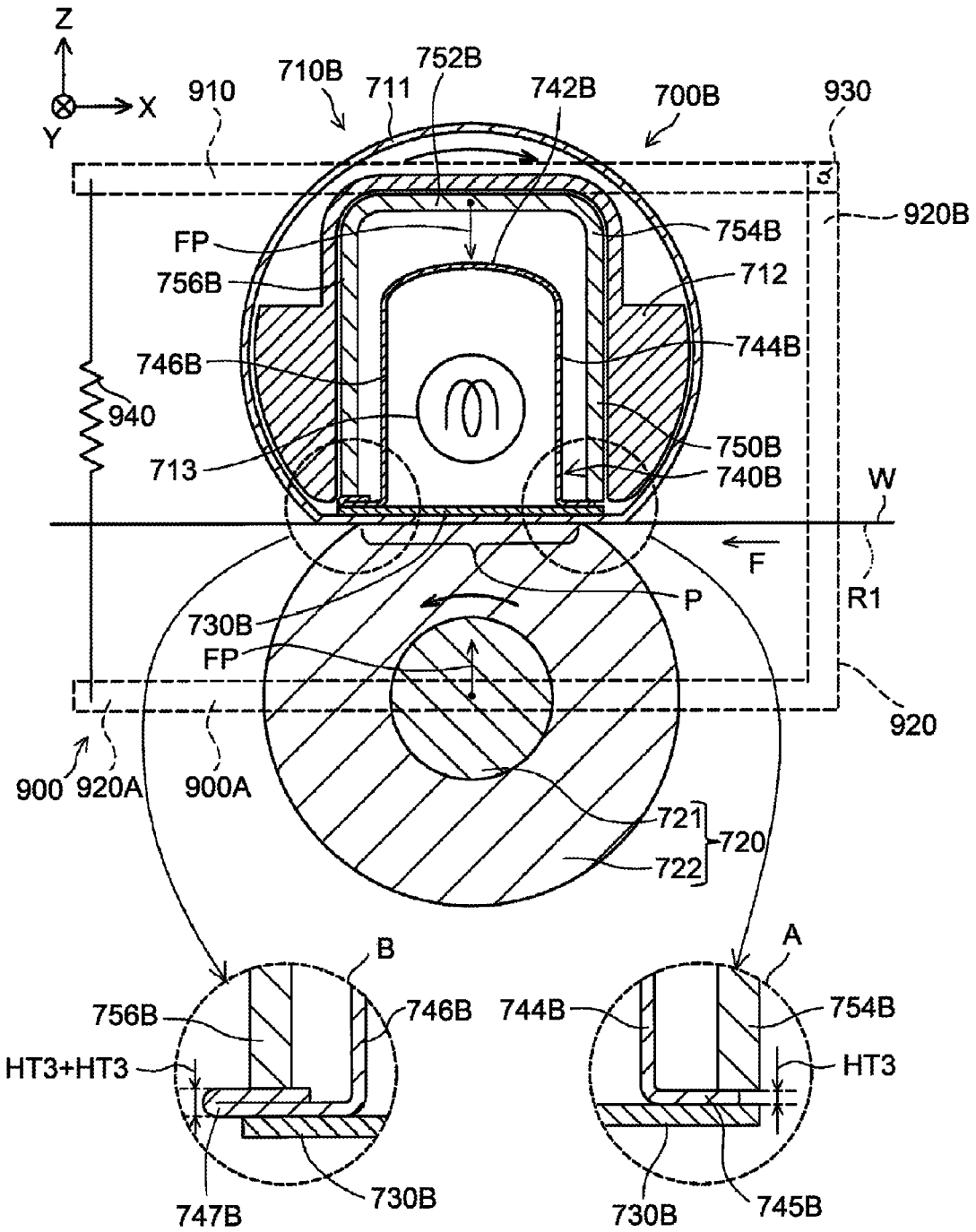
FIG. 10 illustrates a left-side view of a fixing device of further aspect of the present disclosure.

As shown in an enlarged view A in FIG. 10, a lower end 745B of the first reflecting wall 744B is bent toward the first wall 754B of the stay 750B. The entire length of the lower end 745B is substantially parallel to the halogen lamp 713 and is disposed between the first wall 754B and the nip plate 730B such that the lower end 745B contacts the first wall 754B and the nip plate 730B.

As shown in an enlarged view B in FIG. 10, a lower end 747B of the second reflecting wall 746B is bent toward the second wall 756B of the stay 750B. The entire length of the lower end 747B is substantially parallel to the halogen lamp 713. Only the middle portion of the lower end 747B is further bent toward the first wall 754B while the remaining portion of the lower end 747B is bent once. The lower end 747B is disposed between the second wall 756B of the stay 750B and the nip plate 730B such that the lower end 747B contacts the second wall 756B and the nip plate 730B.

The second reflecting wall 746B has a thickness HT3, which is the same thickness of the first reflecting wall 744B and the lower end 745B of the first reflecting wall 744B. Thus the middle portion of the lower end 757B of the second reflecting wall 746B has a height of HT3+HT3.

The height of the middle portion of the lower end 747B is greater than the height of the remaining portion of the lower end 747B. The height of the entire lower end 745B is constant. The characteristic of the configuration of the second another embodiment is similar to the characteristic of the one embodiment of the present disclosure for causing less wrinkle on the sheet W.

The lower end 745B and the lower end 747B, each integrally provided at the first reflecting wall 744B and the second reflecting wall 746B respectively, causes proper heights of the lower end 745B and the lower end 747B, otherwise, each of the lower end 745B and the lower end 747B would be an individual element and be attached to the first reflecting wall 744B and the second reflecting wall 746B respectively to cause inaccurate height.

The present disclosure may include additional or alternate elements/limitations without modifying the scope of the disclosure.

The endless belt 711 may be made of metal, for example, stainless steel, instead of resin in the present embodiment.

The halogen lamp 713 may be disposed outside the loop of the endless belt 711. If so, the reflector 740 may be omitted.

The pressed portion 720 may include another endless belt instead of the elastic body 722.

A height of the rib 734B may be greater than a height of the rib 734A or the rib 734C as long as the height difference between the rib 736B and the rib 736A or the rib 736C is greater than the height difference between the rib 734B and the rib 734A or the rib 734C.

Each of the first support 734 and the second support 736 may be a separate piece from the base plate 732. Each of the first support 734 and the second support 736 may be integrally formed with one of the stay 750 and the thermal insulator 760.

The first support 734 may be two individual ribs. The first support 734 may include four or more individual ribs. The first support 734 may be a single rib extending in substantially parallel to the longitudinal end surface of the base plate 732 as long as a height of the middle portion of the single rib is greater than a height of the remaining portion of the single rib.

The second support 736 may be two individual ribs. The first support 736 may include four or more individual ribs. The first support 736 may be a single rib extending in substantially parallel to the first support 734 as long as a height of the middle portion of the single rib is greater than a height of the remaining portion of the single rib.

A height of the rib 735B may be identical to a height of the rib 734B as long as a height of the rib 736B is greater than a height of the rib 735B. A height of the rib 735B may be identical to a height of the rib 736B as long as a height of the rib 735B is greater than a height of the rib 734B.

The halogen lamp 713 may be replaced with an infrared heater, for example, a metal wire heater, or a far infrared heater such as a carbon heater.

What is claimed is:

1. A fixing device, comprising:

an endless belt having a particular width;

a plate disposed inside of a loop of the endless belt and extending in a widthwise direction that is parallel to the particular width, the plate contacting an inner peripheral surface of the endless belt;

a girder disposed inside of the loop of the endless belt and extending in the width direction, the plate being disposed between the girder and the endless belt;

a pressing member disposed outside of the loop of the endless belt and extending in the widthwise direction, the pressing member contacting an outer peripheral surface of the endless belt and pressing the endless belt toward the plate in a first direction;

a heater disposed inside the loop of the endless belt;

a first support disposed between the plate and the girder and extending in the widthwise direction, the first support contacting the plate and the girder;

a second support disposed between the plate and the girder and extending in the widthwise direction, the second support contacting the plate and the girder while being away from the first support in a forward direction of the endless belt, the forward direction being perpendicular to the widthwise direction;

wherein the first support has a first height at a center region of the first support in the widthwise direction the first support has a second height at an end portion of the first support in the widthwise direction the second support has a first height at a center region of the second support in the widthwise direction, the second support has a second height at an end portion of the second support in the widthwise direction, the first height of the second support is greater than the second height of the second support, and a first difference between the first height of the first support and the second height of the first support is less than a second difference between the first height of the second support and the second height of the second support.

2. The fixing device according to claim 1, wherein the first height of the first support is equal to the second height of the first support.

3. The fixing device according to claim 1, wherein at least one of the first support and the second support is integrally formed with the plate.

4. The fixing device according to claim 1, wherein at least one of the first support and the second support includes an arc shaped portion that contacts the girder.

5. The fixing device according to claim 1, wherein at least one of the first support and the second support includes a contact that extends in the widthwise direction.

6. The fixing device according to claim 1, wherein at least one of the first support and the second support includes a plurality of ribs, each extending in the widthwise direction.

7. The fixing device according to claim 1, further comprises a third support disposed between the plate and the girder and extending in the widthwise direction, wherein the third support is further disposed between the first support and the second support in the forward direction, the third support has a first height at center region of the third support in the widthwise direction, the first height of the third support is greater than the first height of the first support, and the first height of the third support is less than the first height of the second support.

8. The fixing device according to claim 7, wherein a distance in the forward direction between center region of the third support and the center region of the second support is less than a distance in the forward direction between the middle portion of the third support and the center region of the first support.

9. The fixing device according to claim 7, wherein a first slope of an imaginary line connecting a top portion of the first support and the top portion of the third support is less than a second slope of an imaginary line connecting a top portion of the third support and a top portion of the second support, the first slope is determined by dividing a height difference of the top portion of the first support and the top portion of the third support by a distance in the forward direction between the center region of the third support and the middle portion of the first support, and the second slope is determined by dividing a height difference of the top portion of the third support and the top portion of the second support by a distance in the forward direction between the center region of the third support and center region of the second support.

10. A fixing device, comprising:

an endless belt having a particular width;

a plate disposed inside of a loop of the endless belt and extending in a widthwise direction that is parallel to the particular width, the plate contacting an inner peripheral surface of the endless belt;

a stay disposed inside of the loop of the endless belt and extending in the width direction, the plate being disposed between the stay and the endless belt, the stay further comprising:

an upper plate;

a first wall extending toward the plate from the upper plate;

a second wall extending toward the plate from the upper plate;

a heater disposed below the upper plate and between the first wall and the second wall;

a reflector disposed between the upper plate and the heater, between the first wall and the heater and between the second wall and the heater;

a pressing member disposed outside of the loop of the endless belt and extending in the widthwise direction, the pressing member contacting an outer peripheral surface of the endless belt and pressing the endless belt toward the plate in a first direction;

wherein the reflector further comprises:

a first lower end disposed between the plate and the first wall and extending in the widthwise direction, the first lower end contacting the plate and the first wall; and a second lower end disposed between the plate and the second wall and extending in the widthwise direction, the second lower end contacting the plate and the second wall, and wherein a height of the first lower end is less than a height of the second lower end, and wherein at least a portion of the reflector at the second lower end includes a bend such that the height of the second lower end is twice the height of the first lower end.

* * * * *